US008551679B2

(12) United States Patent
Pang et al.

(10) Patent No.: US 8,551,679 B2
(45) Date of Patent: Oct. 8, 2013

(54) TONER, METHOD OF PREPARING THE SAME, METHOD OF FORMING IMAGES USING THE TONER AND IMAGE FORMING DEVICE USING THE TONER

(75) Inventors: Kyeong Pang, Suwon-si (KR); Hong-chul Shin, Suwon-si (KR); Kyung-yoi Yon, Seongnam-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1084 days.

(21) Appl. No.: 12/147,679

(22) Filed: Jun. 27, 2008

(65) Prior Publication Data

US 2009/0155700 A1 Jun. 18, 2009

(30) Foreign Application Priority Data

Dec. 14, 2007 (KR) ..... 10-2007-131077

(51) Int. Cl.
*G03G 9/093* (2006.01)

(52) U.S. Cl.
USPC ..... 430/110.2; 430/110.1; 399/252

(58) Field of Classification Search
USPC ..... 430/110.2, 110.1; 399/252
See application file for complete search history.

(56) References Cited

U.S. PATENT DOCUMENTS

| | | | | |
|---|---|---|---|---|
| 6,080,519 | A * | 6/2000 | Ishiyama et al. | 430/110.3 |
| 6,617,091 | B2 | 9/2003 | Nishimori et al. | |
| 7,141,345 | B2 * | 11/2006 | Yamasaki et al. | 430/110.2 |
| 7,390,606 | B2 | 6/2008 | Patel et al. | |
| 7,476,481 | B2 | 1/2009 | Fujino et al. | |
| 7,829,254 | B2 | 11/2010 | Kurose et al. | |
| 2004/0137357 | A1 | 7/2004 | Bartel et al. | |
| 2005/0100809 | A1 | 5/2005 | Fujino et al. | |
| 2005/0130053 | A1 * | 6/2005 | Ishiyama et al. | 430/108.8 |
| 2005/0175922 | A1 * | 8/2005 | Fujino et al. | 430/110.2 |
| 2007/0087280 | A1 | 4/2007 | Patel et al. | |
| 2007/0218388 | A1 | 9/2007 | Kurose et al. | |
| 2007/0218390 | A1 | 9/2007 | Nozaki et al. | |

FOREIGN PATENT DOCUMENTS

| | | |
|---|---|---|
| JP | 2000122334 | 4/2000 |
| JP | 2005003945 | 1/2005 |
| JP | 2005099223 | 4/2005 |
| JP | 2005141144 | 6/2005 |
| JP | 2006091378 | 4/2006 |
| JP | 2007034277 | 2/2007 |
| JP | 2007086211 | 4/2007 |
| JP | 2007-114775 | 5/2007 |
| JP | 2007279689 | 10/2007 |
| KR | 20070042089 | 4/2007 |
| KR | 100774287 | 11/2007 |

OTHER PUBLICATIONS

Diamond, A.S., et al., ed., Handbook of Imaging Materials, Second Edition, Marcel Dekker, Inc., NY (2002), pp. 146-148.*
Korean Office Action issued Mar. 28, 2012 in KR Application No. 10-2007-0131077.
Korean Notice of Allowance dated May 27, 2013 issued in KR Application No. 10-2007-0131077.
Japanese Office Action dated Jun. 4, 2013 issued in JP Application No. 2008-301317.

* cited by examiner

*Primary Examiner* — Janis L Dote
(74) *Attorney, Agent, or Firm* — Stanzione & Kim, LLP

(57) ABSTRACT

A toner including a plurality of fine particles includes a core including first latex particles, a wax and a pigment, or a first latex particle-wax complex and a pigment, and a first shell layer including second latex particles and covering at least a portion of the surface of the core, a method of preparing the toner, a method of forming images using the toner, and an image forming device including a toner transferring unit. The toner can have improved fixing and charging properties, preserving properties at a high temperature and high humidity, glossness and anti-offset properties by reducing a domain size of a wax dispersed in the toner and improving dispersibility of the wax.

10 Claims, 6 Drawing Sheets

TONER, METHOD OF PREPARING THE SAME, METHOD OF FORMING IMAGES USING THE TONER AND IMAGE FORMING DEVICE USING THE TONER

CROSS-REFERENCE TO RELATED APPLICATIONS

This application claims priority under 35 U.S.C. §119(a) from Korean Patent Application No. 10-2007-0131077, filed on Dec. 14, 2007, in the Korean Intellectual Property Office, the disclosure of which is incorporated herein in its entirety by reference.

BACKGROUND OF THE INVENTION

1. Field of the Invention

The present general inventive concept relates to a toner, a method of preparing the toner, a method of forming images using the toner and an image forming device using the toner, and more particularly, to a toner having improved fixing and charging properties, preserving properties at a high temperature and high humidity, glossness and anti-offset properties by reducing a domain size of a wax dispersed in the toner and improving dispersity of the wax, a method of preparing the toner, a method of forming images using the toner and an image forming device using the toner.

2. Description of the Related Art

In electrophotographic processes or electrostatic recording processes, a developer used to develop an electrostatic image or an electrostatic latent image is classified into a two-component developer formed of toner and carrier particles, and a one-component developer formed of toner only. The one-component developer is classified into a magnetic one-component developer and a nonmagnetic one-component developer. Fluiding agents such as colloidal silica are often independently added to the nonmagnetic one-component developer to increase the fluidity of the toner. Typically, coloring particles obtained by dispersing a pigment such as carbon black, or other additives in a binding resin are used as the toner.

Toner can be prepared by pulverization or polymerization. In pulverization, toner is obtained by melting and mixing synthetic resins with pigments and, if required, other additives, pulverizing the mixture and sorting the particles until particles of a desired size are obtained. In polymerization, a polymerizable monomer composition is manufactured by uniformly dissolving or dispersing various additives such as a pigment, a polymerization initiator and, if required, a cross-linking agent and an antistatic agent in a polymerizable monomer. Then, the polymerizable monomer composition is dispersed in an aqueous dispersive medium which includes a dispersion stabilizer using an agitator to shape minute liquid droplet particles. Subsequently, the temperature is increased and suspension polymerization is performed to obtain polymerized toner having coloring polymer particles of a desired size.

In an image forming device such as an electrophotographic apparatus or an electrostatic recording apparatus, an image is formed by exposing an image on a uniformly charged photoreceptor to form an electrostatic latent image; attaching toner to the electrostatic latent image to form a toner image; transferring the toner image onto a transfer member such as transfer paper or the like; and then fixing the toner image on the transfer member by any of a variety of methods, including heating, pressurizing, solvent steaming and the like. In most fixing processes, the transfer medium with the toner image passes through fixing rollers and pressing rollers, and by heating and pressing, the toner image is fused to the transfer medium.

Images formed by an image forming device such as an electrophotocopier should satisfy requirements of high precision and accuracy. Conventionally, toner used in an image forming device is usually obtained using pulverization. In pulverization, color particles having a large range of sizes are formed. Hence, to obtain satisfactory developing properties, there is a need to sort the coloring particles obtained through pulverization according to size to reduce particle size distribution. However, precisely controlling the particle size and the particle size distribution using a conventional mixing/pulverizing process in the manufacture of toner suitable for an electrophotographic process or an electrostatic recording process is difficult. Also, when preparing a fine-particle toner, the toner preparation yield is adversely affected by the sorting process. In addition, there are limits to change/adjustment of a toner design for obtaining desirable charging and fixing properties. Accordingly, polymerized toner and the size of particles of which is easy to control and which do not need to undergo a complex manufacturing process such as sorting, have been highlighted recently as disclosed in, for example, U.S. Pat. No. 6,617,091.

However, a wax included in a toner may be plasticized due to comparability of the wax with a resin of the toner according to the conventional art, and thus heat preserving properties, fluidity and fixing properties of the toner may be reduced. Those problems may be overcome according to the present general inventive concept.

SUMMARY OF THE INVENTION

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing a toner including a plurality of fine particles, the fine particles including a core including first latex particles, a wax and a pigment, or a first latex particle-wax complex and a pigment, and a first shell layer including second latex particles, and to cover at least a portion of a surface of the core.

The foregoing and/or other aspects and utilities of the general inventive concept may also be achieved by providing a method of preparing a toner, the method including forming a core including first latex particles, a wax and a pigment, or a first latex particle-wax complex and a pigment, forming a first shell layer including second latex particles and covering at least a portion of a surface of the core to form fine particles including the core and the first shell layer, and agglomerating a plurality of the fine particles.

The foregoing and/or other aspects and utilities of the general inventive concept may also be achieved by providing a method of forming images using the toner, the method including attaching the toner to a surface of a photoreceptor on which an electrostatic latent image is formed to form a visualized image and transferring the visualized image to a transfer medium.

The foregoing and/or other aspects and utilities of the general inventive concept may also be achieved by providing an image forming device including a photoreceptor, an image forming unit to form an electrostatic latent image on a surface of the photoreceptor, a unit to receive the toner, a toner supplying unit to supply the toner onto the surface of the photoreceptor in order to form a toner image by developing the electrostatic latent image, and a toner transferring unit to transfer the toner image to a transfer medium from the surface of the photoreceptor.

The foregoing and/or other aspects and utilities of the general inventive concept may also be achieved by providing a toner including a plurality of fine particles including a core having a first latex particle-wax complex and a pigment, wherein the first latex particle-wax complex includes wax having an average domain size in a range of 0.2 to 0.5 μm.

The wax dispersed in the toner may have the average domain size in the range of 0.2 to 0.3 μm.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE PREFERRED EMBODIMENTS

Figure 1:
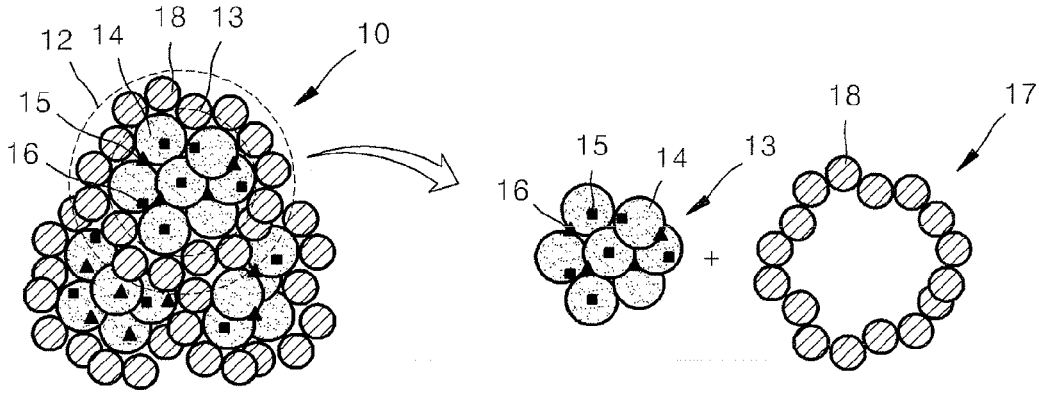
FIGS. 1 to 3 schematically illustrate toner according to embodiments of the present general inventive concept.

Hereinafter, the present general inventive concept will now be described more fully with reference to the accompanying drawings, in which exemplary embodiments of the general inventive concept are illustrated.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

A toner according to an embodiment of the present general inventive concept includes a plurality of fine particles. The term "fine particle" used herein indicates a particle including a core and a first shell layer. The core includes i) first latex particles, a wax and a pigment, or ii) a first latex particle-wax complex and a pigment, and the first shell layer includes second latex particles and covers at least a portion of the surface of the core. The core and the first shell layer will be described in more detail below. In more particular, a plurality of fine particles of the toner may be agglomerated. That is, a toner according to an embodiment of the present general inventive concept may be agglomerated particles including of a plurality of fine particles.

FIG. 1 schematically illustrates a cross-sectional view of toner 10 according to an embodiment of the present general inventive concept. A fine particle 12 is illustrated within an outer dotted circle in FIG. 1. A plurality of the fine particles 12 are agglomerated to form a toner 10. According to the cross-sectional view of the toner 10 of FIG. 1, three fine particles form a toner, but a number of the fine particles constituting the toner 10 may be increased in consideration of three-dimensional structures of the toner 10.

The fine particle 12 includes a core 13 and a first shell layer 17 which covers at least a portion of a surface of the core 13. That is, the first shell layer 17 covers a portion of the surface or the entire surface of the core 13. The first shell layer 17, for example, may be coated on the surface of the core 13.

The core 13 includes first latex particles 14, a pigment 15 and a wax 16. The wax 16 may be dispersed in the entire core 13.

The wax 16 dispersed in the toner 10 may have an average domain size of 0.2 to 0.5 μm, such as 0.2 to 0.3 μm. Although not limited to one theory, this range of the average domain size of the wax 16 may be obtained because the toner 10 includes a plurality of fine particles 12 and the wax 16 is included only in the core 13. Accordingly, the toner 10 of the present general inventive concept has excellent fixing and charging properties due to the domain size of the wax 16 dispersed within the toner 10. Consequently, since the wax dispersity is increased in the toner 10, preserving properties at a high temperature and high humidity, glossness and anti-offset properties may be increased.

Examples of the wax 16 are polyethylene-based wax, polypropylene-based wax, silicon wax, paraffin-based wax, ester-based was, carbauna wax and metallocene wax, but are not limited thereto. The melting point of the wax 16 may be in a range of about 50 to about 150° C.

The first latex particles 14 may be prepared by polymerizing a composition including at least one polymerizable monomer.

The polymerizable monomer is a monomer which can be polymerized. Examples of the polymerizable monomer is at least one monomer selected from the group consisting of styrene-based monomers such as styrene, vinyl toluene and α-methyl styrene; (metha)acrylates and derivatives thereof such as acrylic acid, methacrylic acid, methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide, metacryl amide and b-carboxyethyl acrylate; ethylenically unsaturated monoolefins such as ethylene, propylene and butylenes; halogenized vinyls such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isoprophenyl ketone; and nitrogen-containing vinyl compounds such as 2-vinylpyridine, 4-vinylpyridine and N-vinyl pyrrolidone, but are not limited thereto.

At least one operation of preparing the first latex particles 14, preparing fine particles 12 and preparing toner 10 by agglomerating the fine particles 12 and selectively forming a second shell layer may be carried out without a surfactant.

Accordingly, washing processes may be minimized in a separation and filtration of the prepared toner particles. Manufacturing costs for the toner may be reduced by minimizing a number of washing processes, and the manufacturing process is more environmentally friendly by decreasing an amount of wastewater generated. In addition, high sensitivity in high humidity, low frictional charge, reduced dielectric property and weak toner flow, for example, may be removed since the surfactant is not used. Also, storage stability of the toner can be improved.

The composition for the first latex particle 14 may further include at least one of an initiator for radical polymerization, a chain transfer agent, a releasing agent, a charge control agent, a cross-linking agent and an emulsifier.

Examples of the initiator for radical polymerization are persulfate salts such as potassium persulfate (KPS) and ammonium persulfate; azo compounds such as 4,4-azobis(4-cyano valeric acid), dimethyl-2,2'-azobis(2-methyl propionate), 2,2-azobis(2-amidinopropane)dihydrochloride, 2,2-azobis-2-methyl-N-1,1-bis(hydroxymethyl)-2-hydroxyethylpropioamide, 2,2'-azobis(2,4-dimethyl valeronitrile), 2,2'-azobis isobutyronitrile and 1,1'-azobis(1-cyclohexanecarbonitrile); and peroxides such as methyl ethyl peroxide, di-t-butyl peroxide, acetyl peroxide, dicumyl peroxide, lauroyl peroxide, benzoyl peroxide, t-butylperoxy-2-ethyl hexanoate, di-isopropyl peroxydicarbonate and di-t-butylperoxy isophthalate. Also, an oxidization-reduction initiator in which the polymerization initiator and a reduction agent are combined may be used.

Radicals may be created by the initiator, and the radicals may react with the polymerizable monomer included in the composition for the first latex particles 14.

A chain transfer agent is a material that converts a type of chain carrier in a chain reaction. A new chain has much less activity than that of a previous chain. The polymerization degree of the monomer can be reduced and new chains can be initiated using the chain transfer agent. In addition, a molecular weight distribution can be adjusted using the chain transfer agent.

Examples of the chain transfer agent are sulfur containing compounds such as dodecanthiol, for example, 1-dodecanethiol, thioglycolic acid, thioacetic acid and mercaptoethanol; phosphorous acid compounds such as phosphorous acid and sodium phosphite; hypophosphorous acid compounds such as hypophosporous acid and sodium hypophosphite; and alcohols such as methyl alcohol, ethyl alcohol, isopropyl alcohol and n-butyl alcohol, but are not limited thereto.

The release agent can be used to protect a photoreceptor and prevent deterioration of developing, thereby obtaining a high quality image. The release agent may be a high purity solid fatty acid ester material. Examples of the release agent include low molecular weight polyolefins such as low molecular weight polyethylene, low molecular weight polypropylene and low molecular weight polybutylene; paraffin wax; and multi-functional ester compounds. The release agent may be a multifunctional ester compound composed of alcohol having three functional groups or more and carboxylic acid.

The alcohol having three functional groups or more may be aliphatic alcohols such as glycerin, pentaerythritol and pentaglycerol; alicyclic alcohols such as chloroglycitol, quersitol and inositol; aromatic alcohols such as tris(hydroxymethyl) benzene; and sugar-alcohols such as D-erythrose, L-arabinose, D-mannose, D-galactose, D-fructose, L-lamunose, saccharose, maltose and lactose.

The carboxylic acid as a releasing agent may be aliphatic carboxylic acids such as acetic acid, butyric acid, caproic acid, enantate, caprylic acid, pelargonic acid, capric acid, undecanoic acid, lauric acid, myristic acid, stearic acid, magaric acid, arachidic acid, cerotic acid, sorbic acid, linoleic acid, linolenic acid, behenic acid, and tetrolic acid; alicyclic carboxylic acids such as cyclohexanecarboxylic acid, hexahydroisophthalic acid, hexahydroterephthalic acid and 3,4,5,6-tetrahydrophthalic acid; or aromatic carboxylic acids such as benzoic acid, cumic acid, phthalic acid, isophthalic acid, terephthalic acid, trimethic acid, trimellitic acid and hemimellitic acid.

The charge control agent, for example, may be selected from the group consisting of a salicylic acid compound containing metals such as zinc and aluminum, boron complexes of bis diphenyl glycolic acid and silicate. Dialkyl salicylic acid zinc, boro bis(1,1-diphenyl-1-oxo-acetyl potassium salt), or the like, for example, can be used.

The cross-linking agent controls the cross-linking density of polymers that is formed by the polymerization of the polymerizable monomer. The cross-linking agent may be a compound having at least two polymerizable double bonds. The cross-linking agent may include at least two selected from the group consisting of A-decanediol diacrylate, divinyl benzene, 1,6 hexanediol diacrylate, dipropylene glycol diacrylate, neopentyl glycol diacrylate, trimethylolpropane triacrylate, trimethylolpropane trimethacrylate, pentaerythritol tetraacrylate and dipentaerylthritol hexaacrylate, but the cross-linking agent is not limited thereto.

The emulsifier facilitates emulsification reaction among elements of the composition for the first latex particles 14. The emulsifier forms micelles above a critical micelle concentration (CMC), and the polymerizable monomers react with each other in the micelles. In addition, the emulsifier stabilizes particles formed by reactions among the elements of the composition for the first latex particles 14 in an aqueous solution. Examples of the emulsifier are sodium dodecyl sulfate (SDS), ammonium lauryl sulfate (SLS) and sodium laureth sulfate, but are not limited thereto.

A solvent in the composition for the first latex particles 14 may be water, an organic solvent or a mixture thereof.

An average particle size of the first latex particles 14 is in a range of 50 nm to 1 μm, such as 100 nm to 500 nm. The average particle size of the first latex particles 14 may be selected from the range in consideration of an average particle size of the toner 10.

The pigment 15 may be any known pigment according to a color of the toner 10. When the toner 10 of FIG. 1 is a black toner, carbon black or aniline black may be used as the pigment 15. When the toner 10 is a color toner, carbon black or aniline black is used as a black colorant, and at least one of yellow, magenta, and cyan pigments is further included for colored colorants.

A condensation nitrogen compound, an isoindolinone compound, anthraquinone compound, an azo metal complex, or an alyl imide compound can be used for the yellow pigment. Particularly, C.I. pigment yellow 12, 13, 14, 17, 62, 74, 83, 93, 94, 95, 109, 110, 111, 128, 129, 147, 168, 180, or the like can be used.

A condensation nitrogen compound, an anthraquinone, quinacridone compound, base dye lake compound, naphthol compound, benzo imidazole compound, thioindigo compound, or perylene compound can be used for the magenta pigment. Particularly, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like can be used.

A copper phthlaocyanine compound and derivatives thereof, anthraquinone compound, or base dye lake compound can be used for the cyan pigment. Particularly, C.I. pigment blue 1, 7, 15, 15:1, 15:2, 15:3, 15:4, 60, 62, 66, or the like can be used.

Such pigments can be used alone or in a combination of at least two pigments, and are selected in consideration of color, chromacity, luminance, resistance to weather, dispersion property in toner, etc.

Meanwhile, the core 13 may further include an inorganic salt or an organic/inorganic agglomerating agent in addition to the first latex particles 14, the pigment 15 and the wax 16. The inorganic salt or the organic/inorganic agglomerating agent is included in the composition for the core 13 including the first latex particles 14, the pigment 15 and the wax 16, and initiates agglomeration among the elements of the composition to form a core 13. For example, the core 13 may be formed by ionic strength increased by the addition of the inorganic salt and collision among the elements of the composition for a core 13.

In particular, at the concentration of an inorganic salt higher than the critical coagulation concentration (CCC), agglomeration rapidly occurs by the Brownian motion of the first latex particles 14 since electrostatic repulsion is compensated. At the concentration of an inorganic salt lower than the CCC, agglomeration slowly occurs. Thus, agglomeration of the elements of the composition for a core 13 can be controlled.

The inorganic salt may include at least one selected from the group consisting of NaCl, $MgCl_2$, $MgCl_2.8H_20$, $[Al_2(OH)_n Cl_{6-n}]_m$ ($1 \leq n \leq 5$, $1 \leq m \leq 10$) and $(Al_2(SO_4)_3.18H_2O$, but is not limited thereto.

Examples of the organic/inorganic agglomerating agent are polyaluminum chloride (PAC), polyaluminum sulfate (PAS), polyaluminum sulfate silicate (PASS), polyaluminum chloride calcium (PACC), polysilica iron (PSI), ferrous sulfate, ferric sulfate, ferric chloride, calcium hydroxide and calcium carbonate, but are not limited thereto.

At least a portion of the surface of the core 13 is covered by a first shell layer 17. That is, a portion of the surface or an entire surface of the core 13 is covered with the first shell layer 17. The surface of the core 13 may be coated with the first shell layer 17. The first shell layer 17 includes second latex particles 18 which may not include a wax.

The second latex particles 18 are prepared by polymerizing a composition including at least one polymerizable monomer which is described above. The second latex particles 18 may further include an initiator for radical polymerization, a chain transfer agent, a releasing agent, a charge control agent, a cross-linking agent and an emulsifier which are also described above.

An average particle size of the second latex particles 18 may be in a range of 50 nm to 1 μm, such as 100 nm to 500 nm. The average particle size of the second latex particles 18 may be selected from the range in consideration of an average particle size of the toner 10.

The first shell 17 may have an average thickness of 0.1 to 1.5 μm, such as 0.1 to 0.5 μm. Since the shell layer may not have a wax, the toner 10 may have improved durability, heat preserving properties, fluidity and low temperature deposition properties. When the average thickness of the first shell layer 17 is greater than 0.1 μm, the toner may have good charging properties. Alternatively, when the average thickness of the first shell layer 17 is less than 1.5 μm, the toner has good fixing properties.

In the toner, an acid value of the wax 16≤an acid value of the first latex particles 14≤an acid value of the second latex particles 18. A difference of the acid value between the first latex particles 14 and the second latex particles 18 may be within a range of 5 to 10. When the acid value of the wax 16, the acid value of the first latex particles 14 and the acid value of the second latex particles 18 follow the relation described above, the second latex particles 18 are efficiently attached to the surface of the core 13, and thus the first shell layer 17 can be effectively formed.

The fine particles 12 including the core 13 and the first shell layer 17 may have an average domain size of 0.5 to 3 μm, such as 1 to 3 μm. The average particle size of the fine particles 12 may be within the range described above in consideration of the volume average particle size of the toner 10.

The toner 10 of FIG. 1 includes a plurality of fine particles 12. The toner 10, for example, may be agglomerated particles of a plurality of fine particles 12.

The volume average particle size of the toner 10 may be in a range of 5 to 10 μm, such as 5.5 to 6.5 μm. The toner 10 having the volume average particle size described above may be applied to a dry toner for a high-speed, high-quality printer.

An amount of the wax on the surface of the toner 10 may be 0.1% or less. The amount of the wax may be analyzed using a height of a peak obtained by X-ray photoelectron spectroscopy (XPS). Accordingly, the amount of the wax exposed on the surface of the toner 10 is substantially very low.

A size ratio of the wax 16/the toner 10, $D50_{wax}/D50_{toner}$ is less than 0.1, such as in a range of 0.02 to 0.09. Accordingly, the wax 16 dispersed in the toner 10 has a very low domain size, and the dispersity of the wax 16 in the toner 10 is high.

Figure 2:
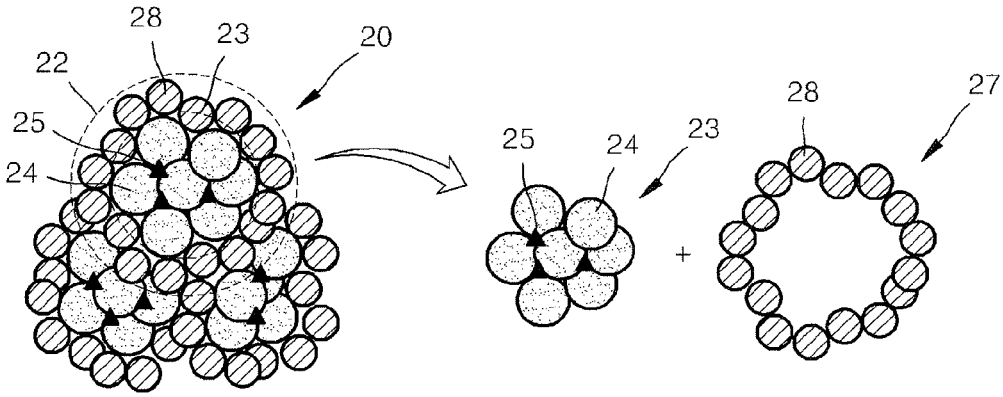

FIG. 2 schematically illustrates a cross-sectional view of toner 20 according to another embodiment of the present general inventive concept. The toner 20 includes a plurality of fine particles 22 which may be agglomerated. The fine particle 22 includes a core 23 and a first shell layer 27. The core 23 includes a first latex particle-wax complex 24 and a pigment 25.

The first latex particle-wax complex 24 may be prepared by dissolving a wax in a mixture having the polymerizable monomer, dispersing the mixture in water to obtain a dispersion, and emulsifying the resultant or emulsification polymerizing the resultant by adding a water-soluble initiator for radical polymerization to the dispersion.

Examples of the wax in the first latex particle-wax complex are polyethylene-based wax, polypropylene-based wax, silicon wax, paraffin-based wax, ester-based was, carbauna wax and metallocene wax, but are not limited thereto. The melting point of the wax 16 may be in a range of about 50 to about 150° C.

The wax in the first latex particle-wax complex 24 may have an average domain size of 0.2 to 0.5 μm, such as 0.2 to 0.3 μm. Although not limited to one theory, this range of the average domain size of the wax may be obtained because the toner 20 includes a plurality of fine particles 22 and the wax is included in the first latex particle-wax complex 24 of the core 23. Accordingly, the toner 20 of the present general inventive concept has excellent fixing and charging properties due to a domain size of the wax dispersed within the toner 20. Consequently, since the wax dispersity is increased in the toner 20, preserving properties at a high temperature and high humidity, glossness and anti-offset properties may be increased.

The first latex particle-wax complex 24 may have an average particle size of 50 nm to 1 μm, such as 100 nm to 500 nm. The average particle size of the first latex particle-wax complex 24 may be selected from the range in consideration of an average particle size of the toner 20.

An average particle size of the fine particles 22 including the core 23 and the first shell layer 27 may be in a range of 0.5 to 3 μm, such as 1 to 3 μm. The volume average particle size of the fine particles 22 may be selected from the range in consideration of a volume average particle size of the toner 20.

The toner 20 of FIG. 2 includes a plurality of fine particles 22 as described above which may be agglomerated.

The toner 20 may have a volume average particle size in a range of 5 to 10 μm, such as 5.5 to 6.5 μm. The toner 20 having the volume average particle size described above may be applied to a dry toner for a high-speed, high-quality printer.

In the toner 20, polymerizable monomers and other additives for preparation of the first latex particle-wax complex 24, elements other than the first latex particle-wax complex 24 and the ratio therebetween, for example, additives included in the core 23, the pigment 25, the first shell layer 27, the second latex particles 28 included in the first shell layer 27 and a ratio of $D50_{wax}/D50_{toner}$ are described above with reference to FIG. 1.

Figure 3:
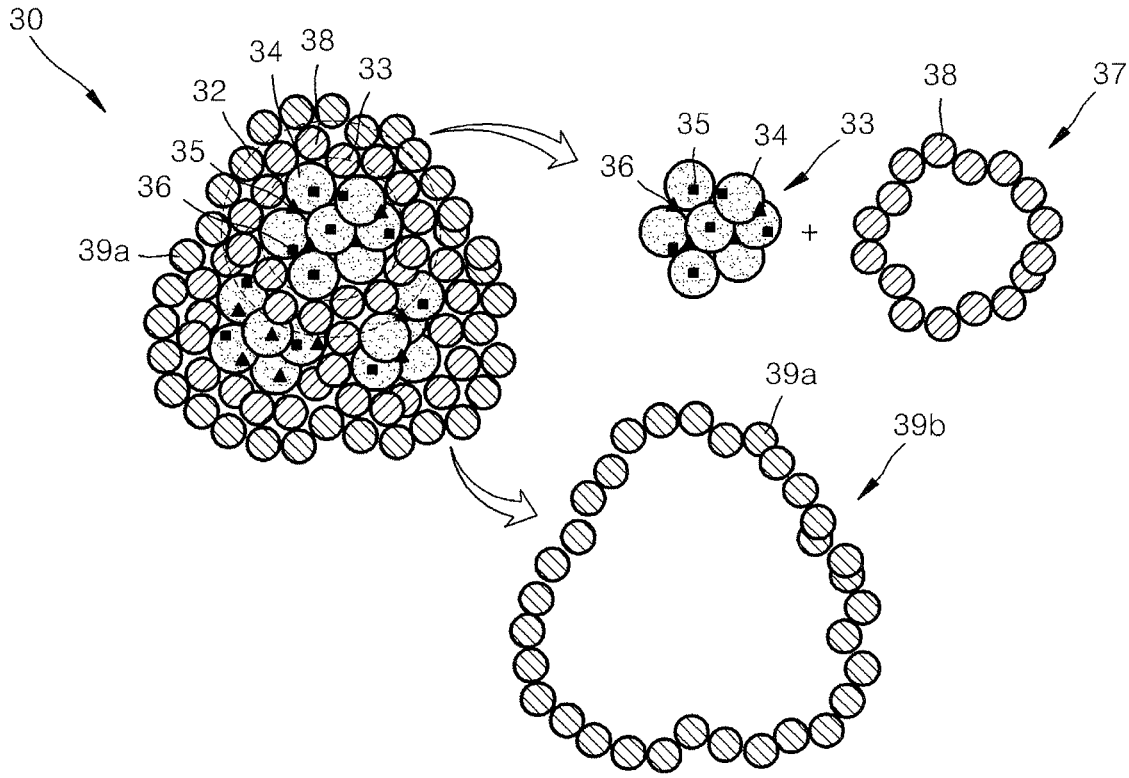

FIG. 3 schematically illustrates a cross-sectional view of toner 30 according to another embodiment of the present general inventive concept. A fine particle 32 is illustrated within an outer dotted circle in FIG. 3. A plurality of the fine particles 32 are agglomerated to form a toner 30. The fine particle 32 includes a core 33 having first latex particles 34, a wax 36 and a pigment 35 and a first shell layer 37 covering at least a portion of the surface of the core 33. The first shell layer 37 includes second latex particles 38. The toner 30 of FIG. 3 further includes a second shall layer 39*b* including third latex particles 39*a* on the surface of agglomerated fine particles 32. The third latex particles 39*a* do not include a wax, and may be the same as or different from the second latex particles 38. The second shell layer 39*b* including the third latex particles 39*a* is illustrated.

In FIG. 3, a total thickness of an average thickness of the first shell layer 37 and an average thickness of the second shell layer 38*b* is in a range of 0.2 to 3 μm, such as 0.2 to 1 μm. The first shell layer 37 and the second shell layer 38*b* having the thickness range described above do not include a wax. Accordingly, the toner 30 can have improved heat preserving properties, fluidity and fixing properties.

In FIG. 3, the third latex particles 39*a* is described with reference to the second latex particles 18 and other elements are described above with reference to FIG. 1.

In addition, various changes may be made in the toner, for example, the core 23 of the toner 20 of FIG. 2 may further include a wax, or the toner 20 of FIG. 2 may further include the second shell layer 39*b* as illustrated in FIG. 3.

A method of preparing a toner according to an embodiment of the present general inventive concept may includes forming a core including first latex particles, a wax and a pigment, or a first latex particle-wax complex and a pigment; forming a first shell layer including second latex particles and covering at least a portion of the core to form fine particles including the core and the first shell layer; and agglomerating a plurality of the fine particles.

The forming the core is performed by agglomerating a mixture of the first latex particles, the wax and the pigment, a mixture of the first latex particle-wax complex and the pigment, or a mixture of the first latex particle-wax complex, the wax and the pigment.

Meanwhile, the method may further include forming a second shell layer including third latex particles on a surface of the agglomerated fine particles to form, for example, a toner illustrated in FIG. 3.

Figure 4:
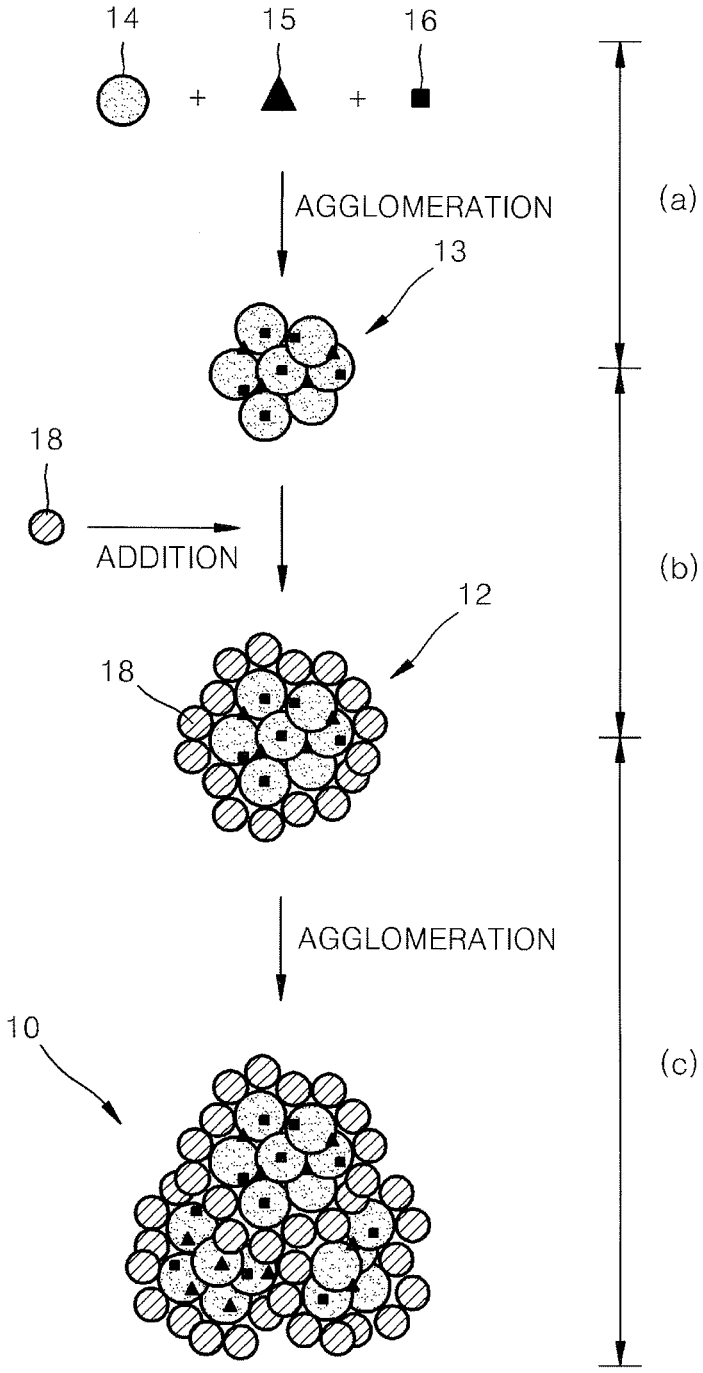
FIGS. 4 and 5 schematically illustrate methods of preparing toner according to embodiments of the present general inventive concept.

FIG. 4 illustrates a method of preparing a toner according to an embodiment of the present general inventive concept. The method will be described in detail with reference to FIG. 4.

First, a core 13 is formed by preparing a composition for a core 13 including first latex particles 14, a pigment 15 and a wax 16 and agglomerating the composition ((a) of FIG. 4).

The first latex particle 14 may be prepared using a composition for first latex particles 14 including at least one polymerizable monomer. Meanwhile, the composition for the first latex particles 14 may further include an initiator for radical polymerization, a releasing agent, a charge control agent, a cross-linking agent, an emulsifier, and the like in addition to the polymerizable monomer.

Specifically, a monomer mixture including polymerizable monomers is added to a reactor with a medium such as distilled deionized water (or a mixture of water and an organic solvent) while the reactor is purged with nitrogen gas, and the reactor is heated while stirring. Here, an electrolyte or an inorganic salt such as NaOH or NaCl may be added to control ionic strength of the reaction medium. The initiator for radical polymerization may be added thereto when the temperature of the reactor reaches an appropriate level. Then, at least one polymerizable monomer may be added to the reactor using a semi-continuous method with a chain transfer agent. Here, polymerizable monomer may be slowly provided using a starved feed process to adjust a reaction speed and dispersibility of the solution.

The polymerization may be performed for 2 to 12 hours and the polymerization time is dependent on the reaction temperature and experimental conditions and determined by measuring reaction speed and conversion rate. After polymerization, monomers may be additionally added to adjust durability or other physical properties of the toner to prepare the first latex particles.

Referring to FIGS. 1 and 4, the pigment 15 may be prepared in a form of a dispersion in which the pigment 15 is dispersed in an emulsifier, or the like. A milling or a homogenizer may be used without limitation as a dispersing means.

The wax 16 may be any wax known in the art, and examples of the wax 16 are described above.

The core 13 including the first latex particles 14, the pigment 15 and the wax 16 is prepared by adding an inorganic salt or an organic/inorganic agglomerating agent to the mixture of the first latex particles 14, the pigment and the wax 16, and agglomerating the resultant.

Then, the fine particles 12 including the core 13 and the first shell layer 17 are prepared by forming the first shell layer 17 including the second latex particles 18 on at least one portion of the core 13 by adding the second latex particles 18 to a mixture including the surface of the core 13 and agglomerating the resultant ((b) of FIG. 4).

The preparation of the second latex particles 18 is described above with reference to an embodiment of the preparation of the first latex particle 14. Here, the acid value of the first latex particles 14 may be less than that of the second latex particles 18.

Then, the toner 10 formed of agglomerated fine particles 12 is prepared by agglomerating a plurality of fine particles 12 ((c) of FIG. 4). An inorganic salt or an organic/inorganic agglomerating agent may be added to the reaction mixture for efficient reaction.

Meanwhile, a toner having a structure illustrated in FIG. 3 may be prepared by agglomerating a plurality of fine particles 12, and further forming a second shell layer including third latex particles on the surface of the agglomerated particles by adding the third latex particles to a reaction mixture including the agglomerated fine particles and agglomerating the resultant, even though the process is not illustrated in FIG. 4.

Thus prepared toner is separated from the reactants and dried. The dried toner is subjected to a surface treatment using external additives such as silica and charge amount is controlled to prepare final dry toner.

Figure 5:
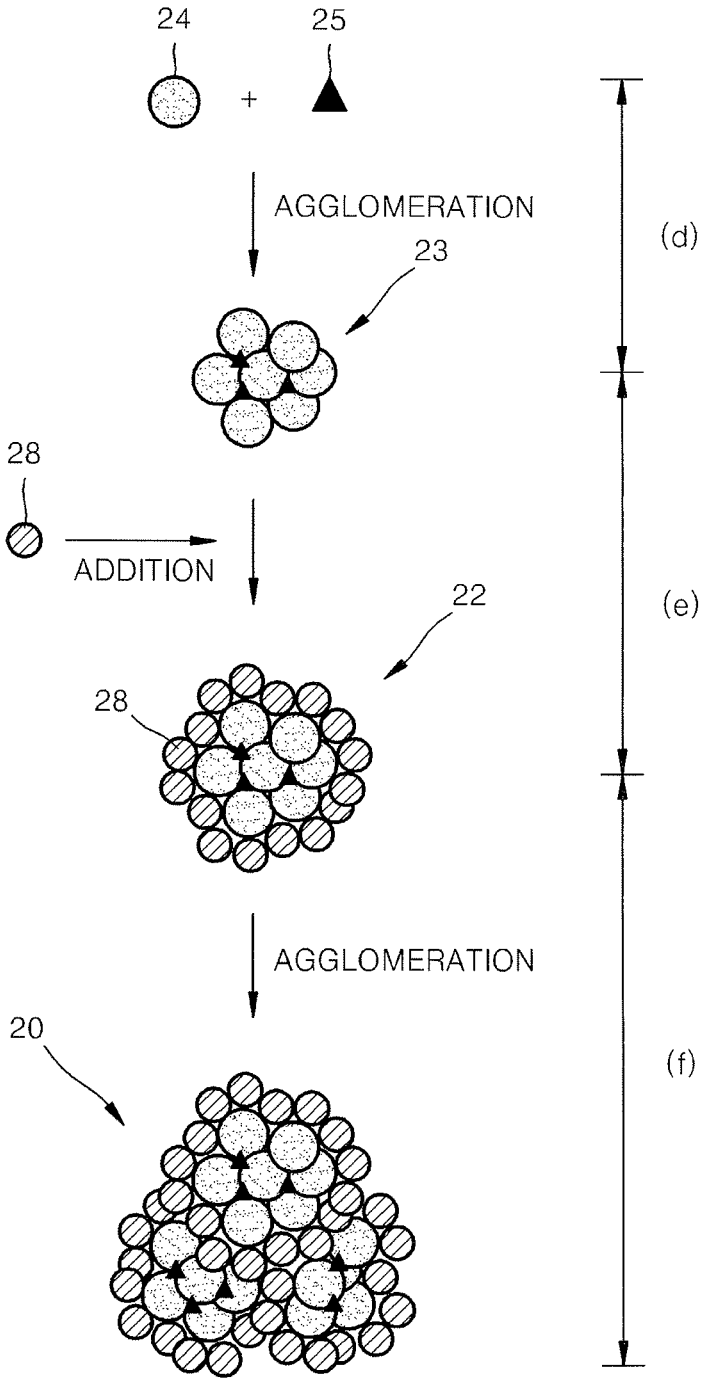

Meanwhile, FIG. 5 illustrates a method of preparing a toner according to another embodiment of the present general inventive concept.

The method of FIG. 5 is different from that of FIG. 4, in that a composition including the first latex particle-wax complex 24 and the pigment 25 is used in the preparation of the core 23 ((d) of FIG. 5).

The first latex particle-wax complex 24 may further include a wax layer that is formed using at least one polymerizable monomer dispersion in which a wax is dispersed. For example, the wax layer may be formed on the surface of the first latex particles by adding a dispersion prepared by dispersing the wax in a monomer mixture including the polymerizable monomer to a mixture having the first latex particles, and adding an initiator, or the like, or other methods can be used to form the wax layer.

Then, fine particles 22 including the core 23 and the first shell layer 27 are prepared by forming the first shell layer 27 including the second latex particles 28 on at least one surface of the core 23 by adding the second latex particles 28 to a mixture including the core 23 and agglomerating the resultant ((e) of FIG. 5). Then, the toner 20 formed of agglomerated fine particles 22 is prepared by agglomerating a plurality of fine particles 22 ((f) of FIG. 5). Meanwhile, even though not illustrated in FIG. 5, the second shell layer including the third latex particles may further be formed on the surface of the agglomerated particles by adding the third latex particles to a mixture including the agglomerated particles and agglomerating the resultant, and various other changes may be made.

According to another embodiment of the present general inventive concept, there is provided a method of forming images using a toner, the method including attaching the toner to a surface of a photoreceptor on which an electrostatic latent image is formed to form a visualized image and transferring the visualized image to a transfer medium, wherein the toner includes a plurality of fine particles. The fine particles include a core including first latex particles, a wax and a pigment, or a first latex particle-wax complex and a pigment, and a first shell layer including second latex particles and covering at least a portion of the core. The toner is described above.

A representative electrophotographic image forming process includes a series of processes of forming images on a receptor including charging, exposure to light, developing, transferring, fixing, cleaning and erasing process operations.

In the charging process, a surface of a photoreceptor is charged with negative or positive charges, whichever is desired, by a corona or a charge roller. In the light exposing process, an optical system, conventionally a laser scanner or an array of diodes, selectively discharges the charged surface of the photoreceptor in an imagewise manner corresponding to a final visual image formed on a final image receptor to form a latent image. Electromagnetic radiation that can be referred to as "light" includes infrared radiation, visible light and ultraviolet radiation.

In the developing process, appropriate polar toner particles generally contact the latent image of the photoreceptor, and conventionally, an electrically-biased developer having identical potential polarity to the toner polarity is used. The toner particles move to the photoreceptor and are selectively attached to the latent image by electrostatic electricity, and form a toner image on the photoreceptor.

In the transferring process, the toner image is transferred to the final image receptor from the photoreceptor, and sometimes, an intermediate transferring element is used when transferring the toner image from the photoreceptor to aid the transfer of the toner image to the final image receptor.

In the fixing process, the toner image of the final image receptor is heated and the toner particles thereof are softened or melted, thereby fixing the toner image to the final image receptor. Another way of fixing is to fix toner on the final image receptor under a high pressure with or without the application of heat.

In the cleaning process, residual toner remaining on the photoreceptor is removed.

Finally, in the erasing process, charges of the photoreceptor are exposed to light of a predetermined wavelength band and are reduced to be substantially uniform and of low value, and thus residue of the organic latent image is removed and the photoreceptor is prepared for a next image forming cycle.

According to another embodiment of the present general inventive concept, there is provided an image forming device including a photoreceptor; an image forming unit to form an electrostatic latent image on a surface of the photoreceptor; a unit to receive toner; a toner supplying unit to supply the toner onto the surface of the photoreceptor in order to form a toner image by developing the electrostatic latent image; and a toner transferring unit to transfer the toner image to a transfer medium from the surface of the photoreceptor, wherein the toner includes a plurality of fine particles including a core including first latex particles, a wax and a pigment, or a first latex particle-wax complex and a pigment; and a first shell layer including second latex particles and covering at least a portion of the surface of the core. The toner is described above.

Figure 6:
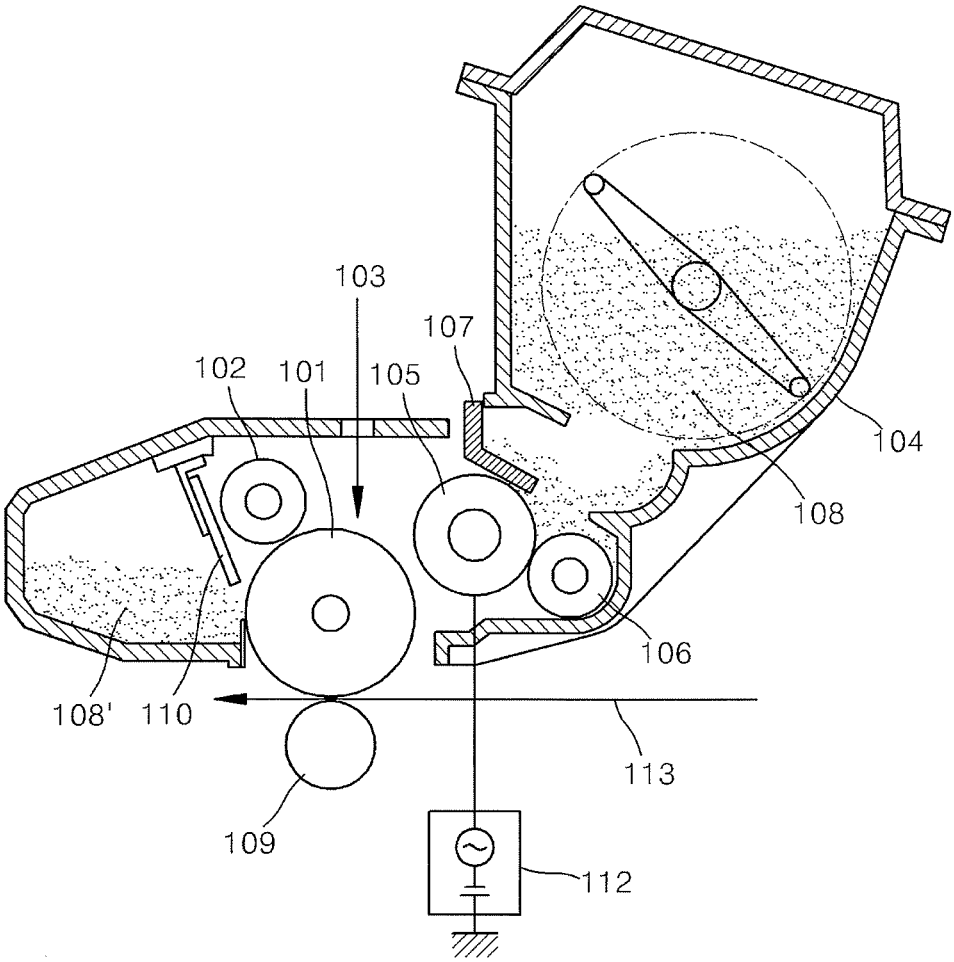
FIG. 6 schematically illustrates an image forming device according to an embodiment of the present general inventive concept.

FIG. 6 illustrates a non-contact developing type image forming device employing toner according to an embodiment of the present general inventive concept. The operating principles of the image forming apparatus are explained below.

A developer 108 of a developing unit 104, is supplied to a developing roller 105 through a feeding roller 106 formed of an elastic material such as a polyurethane foam or sponge. The developer 108 supplied to the developing roller 105 reaches a contact point between the developing roller 105 and a developer regulation blade 107 as the developing roller 105 rotates. The developer regulation blade 107 is formed of an elastic material such as metal, rubber, or the like. When the developer 108 passes the contact point between the developing roller 105 and the developer regulation blade 107, the developer 108 is smoothed to form a thin layer that is sufficiently charged. The developing roller 105 transfers the thin layer of the developer 108 to a developing domain where the thin layer of the developer 108 is developed on the electrostatic latent image of a photoreceptor 101, which is a latent image carrier. The electrostatic latent image is formed by scanning light 103 to the photoreceptor 101.

The developing roller 105 and the photoreceptor 101 face each other with a constant distance therebetween. The developing roller 105 rotates counterclockwise and the photoreceptor 101 rotates clockwise.

The developer 108 transferred to the developing domain of the photoreceptor 101 develops an electrostatic latent image formed on the photoreceptor 101 according to the intensity of an electric charge generated due to a difference between an AC voltage superposed with a DC voltage applied by a power source 112 to the developing roller 105 and a latent image potential of the photoreceptor 101 that is charged by a charging unit 102 to form a toner image.

The developer 108 developed on the photoreceptor 101 is transferred to a transferring device 109 as the photoreceptor 101 rotates. The developer 108 developed on the photoreceptor 101 is transferred to a sheet of paper 113, and as the paper 113 passes through the developer 108 developed on the photoreceptor 101 as corona discharge or as a roller by a transfer unit 109 to which a high voltage having inverse polarity with respect to the developer 108 is applied, thus forming an image.

The image transferred to the printing paper 113 passes through a fusing device (not illustrated) to provide a high temperature and a high pressure, and the image is fixed to the printing paper 113 as the developer 108 is fused to the printing paper 113. Meanwhile, the developer 108' remaining on the developing roller 105 and which is not developed is transferred back to the feeding roller 106 contacting the developing roller 105. A remaining developer 108' that is undeveloped on the photoreceptor 101 is collected by a cleaning blade 110. This process is repeated.

The present general inventive concept will be described in more detail with reference to the examples below, but is not limited thereto. The following examples are for illustrative purposes only and are not intended to limit the scope of the general inventive concept.

EXAMPLES

Synthesis of Latex Particles or a Latex Particle-Wax Complex

Example 1

Synthesis of a Latex Particle 1-Wax Complex

A monomer mixture including 234 g of styrene, 96 g of n-butyl acrylate and 14 g of methacrylic acid was prepared. 5 g of 1-dodecanethiol as a chain transfer agent was added to the mixture and 45 g of WE-5 (NOF Corporation) as a wax was dissolved in the mixture. The resultant was added to 1500 g of a sodium dodecyl sulfate (SDS, Aldrich) solution as an emulsifier and emulsified at a temperature in the range of 60 to 70° C. using an ultrasonic homogenizer. Thus formed wax-monomer dispersion was added to a reactor heated to 80° C., 760 g of a 3.2% potassium persulfate (KPS) solution as an initiator for radical polymerization was added thereto, and the resultant was reacted for 2 hours while the reactor is purged with nitrogen gas. When the reaction is completed, a monomer mixture including 145 g of styrene, 66 g of n-butyl acrylate and 9 g of methacrylic acid and 3.3 g of 1-dodecanethiol were added to the reactor using a starved feed process for 60 minutes and further reacted for 6 hours, and then the resultant was naturally cooled. As a result of measuring the particles size by light scattering using Horiba 910 after the reaction, an average particle size of 200 to 300 nm was identified. The particles are referred to as "latex particle 1-wax complex".

Example 2

Synthesis of Latex Particles 2

A monomer mixture including 899 g of styrene, 262 g of n-butyl acrylate and 36 g of b-carboxyethylacrylate (Sipomer, Rhodia), 4.2 g of A-decanediol diacrylate as a cross-linking agent and 18.8 g of 1-dodecanethiol as a chain transfer agent were added a 3 L beaker. 500 g of a 2% sodium dodecyl sulfate (SDS, Aldrich) solution in water as an emulsifier was added thereto and the mixture was stirred to prepare a monomer emulsified solution. Then, 500 g of a 3.2% potassium persulfate (KPS) solution in water as an initiator for radical polymerization and 1160 g of a 0.13% sodium dodecyl sulfate (SDS, Aldrich) in water as an emulsifier were added to a 3 L double-jacketed reactor heated to 75° C. While the reactor was stirred, the monomer emulsified solution was gradually added thereto for 2 hours, and reacted for 8 hours at 75° C. As a result of measuring the particles size by light scattering using Horiba 910 after the reaction, an average particle size of 150 to 200 nm was identified. The particles are referred to as "latex particle 2".

Preparation of Pigment Dispersion

Example 3

10 g of anionic reactive emulsifier (HS-10;DAI-ICH KOGYO) and 60 g of a black pigment were added to a milling bath, and the mixture was milled with 400 g of glass beads having a diameter of 0.8 to 1 mm at room temperature using an ultrasonic homogenizer to prepare a pigment dispersion K-A. This process was repeated respectively with yellow, magenta and cyan pigments to prepare pigment dispersions Y-A, M-A and C-A. The pigments are as follows.

TABLE 1

| Color | Product (Company) | Pigment dispersion |
|---|---|---|
| Black | Mogul-L (Cabot) | K-A |
| Yellow | PY-74 (Dinichiseika) | Y-A |
| Magenta | PR-122 (Dinichiseika) | M-A |
| Cyan | PB 15:4 (Dinichiseika) | C-A |

Preparation of Toner

Example 4

A mixture of 300 g of the latex particle 1-wax complex, 35 g of K-A pigment dispersion and 500 g of deionized water, and a mixture of 15 g (0.3 mol) of nitric acid and 15 g of PSI (Suiki co. PSI HM 100) were added to a 1 L reactor. The mixture was stirred at 11000 rpm for 6 minutes using a homogenizer to prepare 1.5-2.5 μm agglomerated particles. The mixture including the agglomerated particles was added to a 1 L double-jacketed reactor and the reactor was stirred while heating by 1° C./min from room temperature to 50° C. (Tg of the latex particle 1-5° C.) to identify whether the particles size is about 2 to 3 μm (core formation). Then, 50 g of latex particle 2 prepared according to Example 2 was added thereto and the mixture was reacted for 2 hours to prepare fine particles having the first shell layer having latex particle 2 on the surface of the core. When the fine particles were agglomerated and D50 (volume) of the agglomerated fine particles reached to 5.8 μm, the pH of the mixture was controlled to 7 by adding 1 mol NaOH. When the particle size D50 (volume) was maintained in a constant level for 10 minutes, the reactor was heated to 96° C. by 1° C./min, the pH was adjusted to 6.6 by adding 0.3 mol nitric acid, and reaction was performed for 3 to 5 hours to obtain potato-shaped toner having a diameter of 5 to 6 μm. The agglomerated toner mixture was cooled to below Tg and filtered to separate toner particles, and then the toner particles were dried. The dried toner particles were subjected to a surface treatment using external additives by adding NX-90 0.5 part (Nippon Aerosil), RX-200 1.0 part (Nippon Aerosil) and SW-100 0.5 part (Titan Kogyo) to the dried toner and stirring the mixture at 3000 rpm for 5 minutes using a mixer (Piccolo, Kawata) to obtain toner having a D50 (volume) of 5.8 μm.

Example 5

A mixture of 300 g of the latex particle 1-wax complex, 35 g of K-A pigment dispersion and 500 g of deionized water, and a mixture of 15 g (0.3 mol) of nitric acid and 15 g of PSI (Suiki co. PSI HM 100) were added to a 1 L reactor. The mixture was stirred at 11000 rpm for 6 minutes using a homogenizer to prepare 1.5-2.5 μm agglomerated particles. The mixture including the agglomerated particles was added to a 1 L double-jacketed reactor and the reactor was stirred while heating by 1° C./min from room temperature to 50° C. (Tg of the latex particle 1-5° C.) to identify whether the particles size is about 2 to 3 μm (core formation). Then, 25 g of latex particle 2 prepared according to Example 2 was added thereto and the mixture was reacted to prepare fine particles having the first shell layer having latex particle 2 formed on the surface of the core. When the fine particles were agglomerated and D50 (volume) of the agglomerated fine particles reached to 5.8 μm, 25 g of the latex particle 2 was added to form a second shell layer on the agglomerated fine particles. When the D50 (volume) was 6 μm, 1 mol NaOH was added thereto to adjust the pH of the reaction mixture to 7. When the particle size D50 (volume) was maintained in a constant level for 10 minutes, the reactor was heated to 96° C. by 1° C./min, the pH was adjusted to 6.6 by adding 0.3 mol nitric acid, and reaction was performed for 3 to 5 hours to obtain potato-shaped toner having a diameter of 5 to 6 μm. The agglomerated toner mixture was cooled to below Tg and filtered to separate toner particles, and then the toner particles were dried. The dried toner particles were subjected to a surface treatment using external additives by adding NX-90 0.5 part (Nippon Aerosil), RX-200 1.0 part (Nippon Aerosil) and SW-100 0.5 part (Titan Kogyo) to the dried toner and stirring the mixture at 3000 rpm for 5 minutes using a mixer (Piccolo, Kawata) to obtain toner having a D50 (volume) of 5.8 μm.

Example 6

Toner was prepared in the same manner as in Example 4, except that C-A was used instead of K-A as the pigment dispersion.

Example 7

Toner was prepared in the same manner as in Example 4, except that M-A was used instead of K-A as the pigment dispersion.

Example 8

Toner was prepared in the same manner as in Example 4, except that Y-A was used instead of K-A as the pigment dispersion.

Example 9

Toner was prepared in the same manner as in Example 4, except that 150 g of latex particle 2 (no wax) and 25.4 g of a paraffin-based wax dispersion (Jungkyung Fats) were added to 500 g of deionized water instead of 300 g of the latex particle 1-wax complex for the formation of the core.

Comparative Example 1

A mixture of 150 g of the latex particle 2, 25.4 g of a paraffin-based wax dispersion (Jungkyung Fats), 35 g of K-A pigment dispersion and 500 g of deionized water, and a mixture of 15 g (0.3 mol) of nitric acid and 15 g of PSI (Suiki co. PSI HM 100) were added to a 1 L reactor. The mixture was stirred at 11000 rpm for 6 minutes using a homogenizer to prepare 1.5-2.5 μm agglomerated particles. The mixture including the agglomerated particles was added to a 1 L double-jacketed reactor and the reactor was stirred while heating by 1° C./min from room temperature to 50° C. (Tg of the latex particle 1-5° C.). When particles having a particle size of about 3 to 5.5 μm are less than 2% by volume, 50 g of latex 2 was additionally added thereto. When D50 (volume) reached to 5.8 μm, the pH was controlled to 7 by adding 1 mol NaOH. When the particle size D50 (volume) was maintained in a constant level for 10 minutes, the reactor was heated to 96° C. by 1° C./min, the pH was adjusted to 6.6 by adding 0.3 mol nitric acid, and reaction was performed for 3 to 5 hours to obtain potato-shaped toner having a diameter of 5 to 6 μm. The agglomerated toner mixture was cooled to below Tg and filtered to separate toner particles, and then the toner particles were dried. The dried toner particles were subjected to a surface treatment using external additives by adding NX-90 0.5 part (Nippon Aerosil), RX-200 1.0 part (Nippon Aerosil) and SW-100 0.5 part (Titan Kogyo) to the dried toner and stirring the mixture at 3000 rpm for 5 minutes using a mixer (Piccolo, Kawata) to obtain toner having a D50 (volume) of 5.8 μm.

Evaluation Example 1

Observation of Cross Section of Toner Particles

Cross sections of toner particles obtained from Examples 4 to 9 and Comparative Example 1 and dyed with osmium tetraoxide were observed by transmission electron microscopy (TEM). An average domain size of the dyed portion, that is the wax dispersed in the tonner, was measured and illustrated in Table 2.

Evaluation Example 2

XPS Analysis of Toner Particles

Toner particles obtained from Examples 4 to 9 and Comparative Example 1 were analyzed using X-ray photoelectron spectroscopy (XPS) to analyze the amount of the wax existing on the surface of the toner. The results are illustrated in Table 2.

Evaluation Example 3

Evaluation of Fixing Area of Toner Particles

Device: Belt-type fixing device

Non-fixed image for test: 100% pattern

Test temperature: 100-200° C. (by 10° C.)

Speed: 160 mm/sec

Dwell time: 0.08 sec

Images were formed using toner particles of according to Examples 4 to 9 and Comparative Example 1 of under the conditions illustrated above. After optical density (OD) of the fixed images was measured, 3M 810 tape was attached to the fixed images. The tape was rubbed back and forth using a 500 g weight 5 times, and the tape was removed. Then, OD of the images was measured. The toner fixing degree (%) was calculated using Equation 1.

$$\text{Toner fixing degree (\%)} = (OD \text{ after removing tape}/OD \text{ before removing tape}) \times 100 \quad \text{Equation 1}$$

The temperature resulting 90% or higher toner fixing degree was referred to as a toner fixing region.

MFT: Minimum Fusing Temperature [minimum temperature resulting 90% or higher toner fixing degree without cold-offset]

HOT: HOT Offset Temperature [minimum temperature causing Hot-offset]

Evaluation Example 4

Evaluation of Glossness of Toner Particles

Glossness of toner particles prepared according to Examples 4 to 9 and Comparative Example 1 was measured using a glossmeter, and the results are illustrated in Table 2 (Glossness was measure at 160□ using the fixing device illustrated in Evaluation Example 3).

Angle: 60°

Pattern: 100% pattern

Evaluation Example 5

Evaluation of Preserving Properties of Toner Particles at a High Temperature 100 g of each of toner particles prepared according to Examples 4 to 9 and Comparative Example 1 was subjected to a surface treatment using external additives, added to a developer and stored in a temperature and humidity chamber, at 23° C. and 55% relative humidity (RH) for 2 hours, at 40° C. and 90% RH for 48 hours, at 50° C. and 80% RH for 48 hours, at 40° C. and 90% RH for 48 hours and at 23° C. and 55% RH for 6 hours.

After storing the toner particles in the conditions, caking of toner in the developer was analyzed with the naked eyes. Then, 100% images were printed and evaluated, and the results are illustrated in Table 2.

Standard of Evaluation

◎: good image, No-Caking

○: fair image, No-Caking

Δ: poor image, No-Caking

X: Caking

Evaluation Example 6

Evaluation of Degree of Agglomeration of Toner Particles

The degree of agglomeration of toner particles prepared according to Examples 4 to 9 and Comparative Example 1 was measured using ASTM-6393-99, and the results are illustrated in Table 2. A device and method to measure a degree of agglomeration is described below.

A powder tester PT-S (Hosokawa Micron Co.) having a digital vibrator was used as a device of measuring the degree of agglomeration.

A 53 μm sieve, a 45 μm sieve and a 38 μm sieve were stacked sequentially from the top to bottom. 2 g of toner sample was placed on the top sieve, i.e., 53 μm sieve and stored at 23° C. and 55% RH for 2 hours. The sieve was vibrated for 120 seconds with a 1 mm dial scale of 3 to 3.5. Then, a weight of the sample remained on each of the sieves was measured, and the degree of agglomeration was calculated as follows.

$$[(\text{weight of sample remained on the 53□sieve})/2\text{ g}]\times 100 \quad (1)$$

$$[(\text{weight of sample remained on the 45□sieve})/2\text{ g}]\times 100\times(3/5) \quad (2)$$

$$[(\text{weight of sample remained on the 38□sieve})/2\text{ g}]\times 100\times(1/5) \quad (3)$$

$$\text{Degree of agglomeration}=(1)+(2)+(3) \quad (4)$$

Standard of evaluation

◎: 20% or less

○: 20 to 40%

Δ: 40 to 50%

X: 50% or higher

Evaluation Example 7

Evaluation of Charging Properties of Toner Particles 28.5 g of a magnetic carrier and 1.5 g of toner particles of Example 4 were added to a 60 ml glass reactor, and the mixture was stirred using a turbula mixer. An amount of charged toner particles was measured using a field separation. In particular, charge stability of toner particles with stirring time at room temperature and normal humidity and a ratio of charge amount of high temperature and high humidity/charge amount of low temperature and low humidity. This test was repeated using toner particles of Examples 5 to 9 and Comparative Example 1, and the results are illustrated in Table 2.

Room temperature and normal humidity: 23° C., RH 55%

High temperature and high humidity: 32° C., RH 80%

Low temperature and low humidity: 10° C., RH 10%

Standard of evaluation

◎: Excellent

○: Good

Δ: Fair

X: Poor

TABLE 2

| | Surface wax | Domain size of | | Fixing area | | Charging properties | | | Degree of | Preserving properties at high |
|---|---|---|---|---|---|---|---|---|---|---|
| | (%) | wax (μm) | Gloss | MFT | HOT | Stability | HH/LL | | agglomeration | temperature |
| Example 4 | <0.1 | 0.20 | 8.4 | 140° C. | 210° C. | ○ | 0.65 | ○ | ○ | ◎ |
| Example 5 | <0.1 | 0.27 | 8.1 | 140° C. | 210° C. | ○ | 0.59 | ○ | ◎ | ◎ |
| Example 6 | <0.1 | 0.25 | 7.8 | 130° C. | 210° C. | ◎ | 0.62 | ○ | ○ | ◎ |
| Example 7 | <0.1 | 0.30 | 7.9 | 130° C. | 210° C. | ◎ | 0.58 | ○ | ○ | ◎ |
| Example 8 | <0.1 | 0.22 | 8.9 | 140° C. | 210° C. | ◎ | 0.70 | ○ | ○ | ◎ |
| Example 9 | <0.1 | 0.5 | 9.8 | 130° C. | 210° C. | ○ | 0.51 | ○ | ○ | ○ |
| Comparative Example 1 | 0.1 | 1.5 | 7.8 | 140° C. | 200° C. | X | 0.41 | X | Δ | X |

Figure 7:
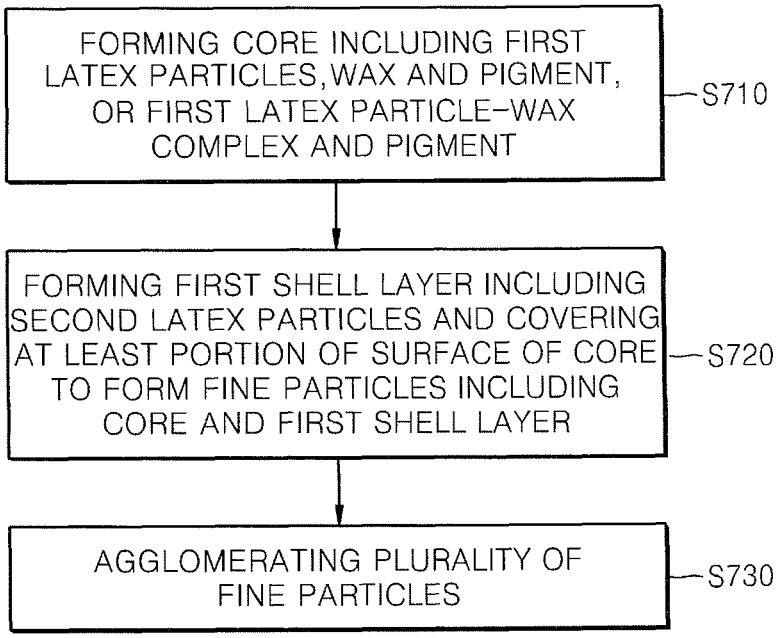
FIG. 7 is a flowchart illustrating a method of preparing a toner according to an embodiment of the present general inventive concept.

FIG. 7 is a flowchart illustrating a method of preparing a toner according to an embodiment of the present general inventive concept. Referring to FIGS. 4 and 7, in operation S710, a core 13 including first latex particles 14, a wax 16 and a pigment 15, or a first latex particle-wax complex 24 (FIG. 5) and a pigment 25 (FIG. 5) is formed. In operation S720, a first shell layer including second latex particles 18 and covering at least a portion of a surface of the core 13 to form fine particles 12 including the core 13 and the first shell layer is formed. In operation S730, a plurality of the fine particles 12 is agglomerated.

The toner according to the present general inventive concept can have improved fixing and charging properties, preserving properties at a high temperature and high pressure, glossness and anti-offset properties by reducing a domain size of a wax dispersed in the toner and improving dispersity of the wax, and thus a toner for a high-speed, high-quality printer can be prepared.

While the present general inventive concept has been particularly illustrated and described with reference to exemplary embodiments thereof, it will be understood by those of ordinary skill in the art that various changes in form and details may be made therein without departing from the spirit and scope of the present general inventive concept as defined by the following claims.

What is claimed is:

1. A toner, comprising agglomerations of fine particles, the fine particles each comprising:
- a core comprising a latex particle-wax complex and a pigment; and
- a first shell layer covering the core and comprising latex particles,
- wherein the wax in the toner has an average domain size of 0.2 to 0.5 μm.

2. The toner of claim 1, wherein the first shell layer has an average thickness of 0.1 to 1.5 μm.

3. The toner of claim 1, wherein each of the fine particles has an average domain size of 0.5 to 3 μm.

4. The toner of claim 1, wherein the toner has a volume average particle size of 5 to 10 μm.

5. The toner of claim 1, further comprising second shell layers comprising latex particles, the second shell layers covering each agglomeration of the fine particles.

6. The toner of claim 5, wherein the average domain size of the wax of the latex particle-wax complex is in a range of 0.2 to 0.5 μm.

7. The toner of claim 1, wherein the latex particle-wax complex comprises wax particles disposed within a latex particle.

8. The toner of claim 1, wherein the latex particle-wax complex has an average particle size of from 50 nm to 1 μm.

9. An image forming device, comprising:
- an photoreceptor;
- an image forming unit to form an electrostatic latent image on a surface of the photoreceptor;
- a toner comprising agglomerations of fine particles, the fine particles each comprising:
  - a core comprising a latex particle-wax complex and a pigment; and
  - a first shell layer covering the core and comprising latex particles;
- a toner supplying unit to supply the toner onto the surface of the photoreceptor in order to form a toner image by developing the electrostatic latent image; and
- a toner transferring unit to transfer the toner image to a transfer medium from the surface of the photoreceptor,
- wherein the wax in the toner has an average domain size of 0.2 to 0.5 μm.

10. A toner comprising agglomerations of fine particles, the fine particles each comprising:
- a core comprising first latex particles, a wax, and a pigment; and
- a first shell layer covering the core and comprising second latex particles,
- wherein an acid value of the wax is less than an acid value of the first latex particles, and the acid value of the first latex particles is less than an acid value of the second latex particles of the first shell layer, and the wax in the toner has an average domain size of 0.2 to 0.5 μm.

* * * * *